US011311438B2

(12) United States Patent
Langer

(10) Patent No.: US 11,311,438 B2
(45) Date of Patent: Apr. 26, 2022

(54) CUSTOMIZABLE PRESSURE OFFLOADING CUSHIONING DEVICE

(71) Applicant: Global Medical Foam, Inc., Lexington, OH (US)

(72) Inventor: Victoria A. Langer, Lexington, OH (US)

(73) Assignee: GLOBAL MEDICAL FOAM, INC., Lexington, OH (US)

( * ) Notice: Subject to any disclaimer, the term of this patent is extended or adjusted under 35 U.S.C. 154(b) by 154 days.

(21) Appl. No.: 16/451,320

(22) Filed: Jun. 25, 2019

(65) Prior Publication Data

US 2019/0307622 A1 Oct. 10, 2019

Related U.S. Application Data

(63) Continuation-in-part of application No. 15/162,574, filed on May 23, 2016, now abandoned.

(60) Provisional application No. 62/179,872, filed on May 21, 2015.

(51) Int. Cl.

| | |
|---|---|
| ***A61G 7/057*** | (2006.01) |
| ***A47C 31/12*** | (2006.01) |
| ***A47C 27/14*** | (2006.01) |
| ***A47G 9/10*** | (2006.01) |
| ***A47C 20/00*** | (2006.01) |

(52) U.S. Cl.

CPC ..... *A61G 7/05723* (2013.01); *A47C 27/146* (2013.01); *A47C 31/123* (2013.01); *A61G 7/05707* (2013.01); *A47C 20/021* (2013.01); *A47G 9/1081* (2013.01); *A47G 2009/1018* (2013.01)

(58) Field of Classification Search

CPC ..... A61G 7/072; A61G 7/05723; A61G 7/05707; A61G 2009/1018; A47G 9/1081; A47C 31/123; A47C 27/146; A47C 20/021

See application file for complete search history.

(56) References Cited

U.S. PATENT DOCUMENTS

| | | | | |
|---|---|---|---|---|
| 3,829,917 A | | 8/1974 | De Laittre | |
| 4,903,359 A | * | 2/1990 | Rogers | A47C 27/146 5/730 |
| 4,980,936 A | * | 1/1991 | Frickland | A47C 27/146 5/420 |
| 5,014,377 A | * | 5/1991 | Dixon | A47G 9/109 5/636 |
| 5,038,433 A | | 8/1991 | Farley | |
| 5,153,956 A | | 10/1992 | Nold | |

(Continued)

FOREIGN PATENT DOCUMENTS

WO 2009029806 A2 3/2009

*Primary Examiner* — David R Hare
*Assistant Examiner* — Alexis Felix Lopez
(74) *Attorney, Agent, or Firm* — Jacob M. Ward; Ward Law Office LLC

(57) ABSTRACT

The subject invention is a device intended for use where support or restriction of motion of a body part is desired. The subject of the present invention is the formation of a network of lattice intrusions into the matrix of the device so that elements of the lattice can be removed to form a depression in the matrix of the device that conforms to the anatomy of the region that is being supported and positioned while offloading pressure.

19 Claims, 6 Drawing Sheets

(56) References Cited

U.S. PATENT DOCUMENTS 5,452,488 A * 9/1995 Reinhardt ..... A47C 27/14 5/729
5,459,896 A 10/1995 Raburn et al.
5,533,218 A 7/1996 Fahy
5,677,036 A * 10/1997 Kording ..... A61F 5/01 428/156
D394,578 S 5/1998 Raburn et al.
5,960,497 A * 10/1999 Castellino ..... A47C 27/146 5/665
6,256,819 B1 * 7/2001 Maier ..... A47C 7/185 297/452.26
6,381,784 B1 * 5/2002 Davis ..... A61G 7/07 5/636
6,442,780 B1 * 9/2002 Phillips ..... A47C 27/146 5/730
6,625,830 B2 9/2003 Lampel
6,743,325 B1 * 6/2004 Taylor ..... B32B 5/026 156/265
7,146,666 B2 12/2006 Christofferson et al.
9,005,101 B1 * 4/2015 Van Erlach ..... A61B 5/1114 600/9
2001/0009043 A1 7/2001 Langer
2004/0123382 A1 7/2004 Berge
2006/0048300 A1 3/2006 DiGirolamo
2007/0070684 A1 3/2007 Poulos
2008/0035156 A1 2/2008 Hyde et al.
2009/0013472 A1 * 1/2009 Koffler ..... A47C 27/15 5/652.1
2009/0093990 A1 * 4/2009 McGuire ..... G01N 3/40 702/139
2010/0146706 A1 * 6/2010 Siegner ..... A61G 1/04 5/626
2011/0083269 A1 4/2011 Glass
2011/0094033 A1 4/2011 Lee
2011/0094034 A1 4/2011 Cortright
2011/0185505 A1 8/2011 Davis
2014/0325763 A1 11/2014 Mason
2014/0352066 A1 12/2014 Chen
2016/0022063 A1 1/2016 Fulkerson et al.
2016/0030263 A1 2/2016 Agajanian
2016/0152168 A1 6/2016 Ito
2016/0278553 A1 * 9/2016 Biebl ..... A47G 9/1081

* cited by examiner

| | |
|---|---|
| SENSING AREA ($in^2$) | 30.51 |
| COEFFICIENT OF VARIATION (%) | 60.50 |
| AVERAGE (mmHg) | 8.87 |
| REGIONAL DISTRIBUTION (%) | 100.00 |

CUSTOMIZABLE PRESSURE OFFLOADING CUSHIONING DEVICE

CROSS-REFERENCE TO RELATED APPLICATIONS

This application is a continuation-in-part of U.S. patent application Ser. No. 15/162,574, filed on May 23, 2016, which in turn claims the benefit of U.S. Provisional Application No. 62/179,872, filed on May 21, 2015. The entire disclosures of the above applications are hereby incorporated herein by reference.

FIELD

The present disclosure relates to a device and method for supporting and restricting motion of a body part and, more specifically, a pressure redistribution and off-loading positioning device and related method.

BACKGROUND

The nervous system of humans and higher animals is uniquely developed to perceive sensations that present a risk of harm to the being. One of those threats is prolonged pressure at a point of contact. Prolonged pressure or point pressure loading on the tissues is uncomfortable and may be painful. The transmission of a signal of discomfort or pain to the brain stimulates a counter signal from the brain to the skeletal muscles calling for some movement. This movement is intended to alleviate the pressure.

Prolonged point loading is deleterious and can lead to significant tissue damage and, in some cases, life-threatening injuries. Gravity places forces on the body to generate the sensation of mass. The body is prevented from sinking to the center of Earth by whatever structure it might be resting on. This is easy to relate to when one considers that, when standing, there is considerable pressure on the soles of the feet but almost none on the palms of the hand. Bony protrusions such as the point of the elbow, back of the head, hips, and knees are just some examples of places that typically end up being prominent contact points counteracting the force of gravity depending upon the position of the body. If the nervous system does not sense, or the body is unable to respond to the signals of prolonged pressure, an adverse situation can arise.

Prolonged pressure has a profound effect on the soft tissues. When blood vessels, muscle, subcutaneous fat, and skin are compressed between bone and an external surface it compromises the normal functions of that area. These opposing forces result in a cone-shaped pressure gradient (Pressure Ulcers-Guidelines for Prevention and Nursing Management, Second Edition). All of the tissue between the external surface and the skeletal anatomy is involved. However, the greatest tissue destruction is beneath the skin surface at the bony interface. If left undisturbed this decreased circulation to the area can drive the oxygen tension of the region into a state of hypoxia and eventually necrosis. The necrotic area can then rupture into a wound that begins inside the body and erodes to the outside. These are often referred to as "pressure injuries" (NPUAP, National Pressure Ulcer Advisory Panel).

Pressure injuries/ulcers are difficult to detect until they have eventually erupted to the outside skin. By that time there is considerable tissue damage that creates an ideal location for the establishment of an infection and, if left untreated, may become life threatening to the individual.

Normal healthy individuals are seldom afflicted with pressure injuries/ulcers because the sensation of point loading is a strong driver to change positions to offload the weight on the affected tissues. Medically compromised individuals are much more susceptible to the development of pressure injuries/ulcers. In many cases medically compromised individuals may lack the energy or strength to change positions. In other cases, they simply may not perceive the pressure on the affected tissues and thereby not have any urge to change positions. These are reasons why a main feature of skilled nursing of medically compromised individuals involves protection against the development of pressure injuries/ulcers. This medical condition is so prominent and dangerous to the health of compromised patients that there is a guideline for care givers for pressure injury/ulcer prevention (Pressure Ulcers-Guidelines for Prevention and Nursing Management, Second Edition).

Protecting patients from the development of pressure injuries/ulcers due to prolonged unrelieved pressure involves monitoring pressure points and making sure that persistent pressure contact does not occur. In some cases, this may be done by turning the patient to reposition body weight on a regular time schedule to allow for capillary refill time for good skin integrity. For example, the bony prominence of the hip may be a point where a pressure injury/ulcer may develop. By turning the patient from one side to the other on a regular basis can be successfully used to prevent tissue hypoxia from occurring. Scheduled repositioning is a normal program used in many long term care, and acute care facilities to prevent pressure injury/ulcer formation.

Studies indicate that comprehensive prevention programs are effective in reducing incidence rates and can be cost effective (Courtney H. Lyder, ND-Pressure Ulcer Prevention and Management). Thus, prevention is critical to reduce overall health costs (AHRQ, Agency for Healthcare Research and Quality-Preventing Pressure Ulcers in Hospitals, A Toolkit for Improving Quality of Care). In the U.S. 2.5 million patients develop pressure ulcers each year. Pressure ulcers cost $9.1-$11.6 billion per year to the US health care system. The cost of individual patient care ranges from $20,900 to $151,700 per pressure ulcer. Medicare estimated in 2007 that each pressure ulcer added $43,180 in costs to a hospital stay. More than 17,000 lawsuits are related to pressure ulcers annually. It is the second most common claim after wrongful death and greater than falls or emotional distress (Goebel et al, Clinical Practice Guidelines for pressure ulcer prevention can prevent lawsuits in older patients. JWOCN). In a study of the impact of compliance on medical malpractice awards: 35 Plaintiffs were awarded $14,418,770. Had health care defendants followed guidelines $11,389,989 might have been saved in 20 lawsuits in addition to the plaintiffs' pain and suffering from resulting pressure injuries/ulcers.

Turning a patient or offloading a pressure point is simplistic in concept but can be problematic in making sure that the patient remains in the desired position. Nursing care often use pillows or blankets rolled in such a way to "pack" in around the patient to assist in maintaining the desired position. Whilst these approaches have some utility they are not always useful for offloading the weight. In fact, in some cases pillows and blankets packed too tightly lead to the very complication that they were intended to alleviate. To better serve the patient's needs and to facilitate offloading of pressure more uniformly, products such as the Global Medical Foam, Inc. (Langer, U.S. Pat. No. 6,360,388) positioning devices have been developed. These devices are cushioning for the body region and have unique designs that ensures a more even distribution of weight over the device. The devices are constructed of polyurethane foam with a solid foam core for rigidity surrounded by a softer foam layer uniquely cut so that it projects foam fingers outwardly from the core. The fingers compress and bend in such a way that the pressure loading is very evenly distributed over a much larger area of the body and the core center is intended to support the body weight. Moreover, because of the unique finger projects they can be wedged in place to very adequately and comfortably support patients in an offload position and in some cases can decrease the frequency for skilled nursing to assist in repositioning.

A wide variety of medical devices have been developed for pressure reduction/pressure redistribution. One such device by Mead et al (PCT/US 2008/074812) is a bladder that contains a combination of elastomeric foam and a light weight fluid wherein the fluid freely moves within the bladder to accommodate weight distribution and the foam prevents "bottoming out" of a part of the anatomy when it is used. In another product marketed by Sunrise Medical (Christofferson, et al, U.S. Pat. No. 7,146,666), the bladder is specially constructed to have internal baffles that allow air, as the support medium, to move somewhat freely through the device when it is used to cushion the patient. This device has advantages of being very lightweight and cushioning but does have some limitations in the true distribution of weight evenly over the device. In another invention, a wheelchair cushion with an anatomical support includes a patient interface layer of gel, a matrix panel and a foam base (Lampel, et al, U.S. Pat. No. 6,625,830). Although gels that are free to move aid in distribution of weight they have the limitation of being very poor support media and have a high potential for bottoming out and do not provide the offloading attribute thus potentially causing tissue interface pressure.

There are many examples of devices that have design features and material choices for aiding in the offloading of areas of the anatomy. Synthetic and natural rubberized materials are commonly used for this purpose primarily because they are generally soft to the touch and naturally provide some cushioning. Open and closed cell foams such as those formed of polyurethane are commonly used. Other foams are composed of natural latex or polyvinyl materials. Collectively these are elastomeric foams. All foams can be evaluated and given an RMA Value (Rubber Manufacturers of America) which relates to the cushioning or softness of the foam. Ideally the foam of choice is one that is constructed of sufficient elasticity, flexibility, conformability etc. so that it distributes weight but does not bottom out when it is used to support the anatomy. In most cases the combination of device design and the cushioning index of the material used in its construction combine to provide some utility of design.

Offloading is a medical necessity to prevent pressure injury/ulcer formation. The repositioning of the body is effective for many patients. However, there are some patients where repositioning is not an option. Patients in prolonged traction, patients that are confined to lie on their back, side or stomach for some medical reason, or burns patients. Although regular scheduled repositioning may not be an option they are still susceptible to the formation of ulcers. In other cases, a patient may already have pressure induced, surgery induced or trauma induced wounds that need total offloading. In cases such as these it is imperative that support surfaces be such that they significantly redistribute the weight of the patient over a much broader tissue surface area. In addition, it may be necessary that the weight be totally offloaded from some portion of the anatomy. Special devices such as air bed mattresses are an example of devices that attempt to significantly redistribute weight, but they may not totally offload weight from specific regions of the anatomy. In addition, these may be effective for the entire body, but they may not either be available, are too expensive, or they may be ineffective when only a portion of the anatomy needs offloading. Furthermore, many support devices come as one size fits all which is entirely unpractical in many cases. There is a need for devices that can be customized to offload and redistribute body weight pressure effectively particularly areas of specific anatomy. Such a customized device might be one that could be modified at bedside to fit a region of an arm, a leg, a backside or the head taking into account that arms, legs, feet, heads, etc. vary in size and shape among the multitude of patients that may need such assistance. Such a device would be a customizable device in the sense that material could be selectively removed from the device so as to shape it to conform very specifically to the anatomy in need of support. Such a device furthermore could be conformable to totally offload the weight that might cause damage to specific anatomical sites. Such a device would be considerably different from existing art in the sense that the customizable features would enable the care giver to modify the device for the patient's specific needs. The invention described herein is a customizable device that is able to be very simply modified to conform in shape and utility to aid in the management of a patient's anatomy for the aim of providing comfort, and offloading to prevent the formation of pressure injuries/ulcers.

Several inventors have proposed improvements in support devices that are intended to better prevent pressure injuries from occurring. In one such improvement, Christofferson (Christofferson et al, U.S. Pat. No. 7,146,666) described a bladder which contained a fluid medium that was free to move within the bladder to conform to the contours of the anatomy. Such a device achieves very good contour to form conformation to the anatomy, but it is not a good system for weight distribution and can not totally offload weight from a wound site if that is required.

Raburn et al (Raburn et al, U.S. Pat. No. 5,459,896) described a way of improving the cushioning support provided by polyurethane foam by describing the formation of a grid like pattern of channels into the anatomy-contact side of a foam device wherein the cuts specifically removed a portion of foam so that the grid projections of foam were totally independent and not touching adjacent projections. This relief of foam allowed the grid portions of foam to move independently but did not provide any ability to totally offload an area if needed nor did it provide any contour fitting of the device to conform to the anatomical shape of the supported anatomy.

Farley (Farley et al, U.S. Pat. No. 5,038,433) was substantially similar to the Raburn invention but provides more relief at the bottom of the channels so that moisture vapor and air more freely moves through the channels of the device. This is said to decrease the accumulation of body perspiration in the device.

All of these inventions substantially improved the weight distribution problem that is so necessary for the management of persons confined to prolonged sitting or reclined positioning. However, these devices address either pressure redistribution or contouring of the device but none of them address the totality of the needs for managing anatomical positioning, pressure re-distribution and total offloading for patients with restricted mobility. There has been a need for a device that provides weight re-distribution, positioning of the anatomy and a potential for total offloading of an anatomical area. Since all of these needs are prescribed by medical needs of the individual patient, and often one with limited mobility, the ideal device would incorporate all of these requirements into a single device. In addition, due to the differences of the anatomical features that make individuals distinctive from one another, it makes sense that a composite of these features also has some degree of flexibility for "molding" the device to fit the individual.

The solution to this unmet need is a customizable cushioning support device that, in preparation for use, is able to be modified to more closely fit the anatomical surface area contours where positioning, weight redistribution, and offloading are needed to meet the care requirements of the patient to more comfortably stabilize the position where immobilization and/or support of the anatomy is desired. Such a device would have utility in clinical application in that it would allow the patient's care givers to shape the device to more precisely fit to the contours of the anatomy the device it is intended to contact. A predominate feature of such an invention would be ease of use, bedside adaptability to the patient's needs, functionality in positioning and support, and affordability. Foams, such as polyurethane and viscoelastic foams, are widely used in support devices of the nature used for positioning and weight distribution. However, these foams are homogeneous materials composed of either closed or open cells with varying degrees of compressibility due to their density and thickness. These materials have very limited utility in their raw manufactured form. To provide more useful devices for intended purposes developers have found that modifying the foam buns with cuts, coatings and designs substantially improve their utility for positioning, weight redistribution or offloading when used in the patient settings. The invention herein described is an improvement whereby foams such as polyurethane or viscoelastic can be fabricated to form a product that enables the patient and/or care giver the ability to easily modify its shape to conform to the anatomical features of the patient to provide positioning, weight redistribution and offloading of specific parts of the anatomy to aid in the prevention of pressure induced injuries/ulcers.

SUMMARY

The subject of this invention is a foam device such as a polyurethane or viscoelastic foam that has been manufactured in such a way that it is easily modified at the point of use, such as at the patient bedside, to provide positioning, weight redistribution and/or partial or total offloading of weight from a specific area of a patient's anatomy. The salient feature of the invention is the formation of small pillars of foam matrix in the foam bun where said small pillars of the foam matrix that are formed into the anatomical contact side of the device. The intention of the pillars of foam projecting from intact base portion of the device is to provide a lattice of closely adjoined structures that can be selectively decreased in length by the care giver to cause the formation of depression(s) in the matrix that conforms to the contours to the anatomical region where it will be used on the patient.

Polyurethane foam of a 1-5 pound per cubic foot density is an ideal soft material that can be easily formed at manufacturing to accomplish the desired features of the device. Polyurethane foam or other elastomeric foam provides uniformly soft homogeneous materials that are often used in mattresses, pillows, support, and positioning devices. Most of these devices are machine cut from large buns of foam. These machines use blades, compression points, and wires that are programmed to cut very precise shapes and sizes into the off-cuts in forming the finished device. Although foams are soft, pliable and elastic they are not easily cut or trimmed by hand with any degree of precision, particularly in the rushed clinical environment. Indeed, precision cutting and shaping of polyurethane foam from buns of foam requires sophisticated programmable machinery that is entirely impractical to house in the clinical environment. Although polyurethane foam is an ideal material that has been used extensively in support devices, its utility as a customizable device has traditionally been limited.

The present invention overcomes this limitation by adding manufactured intrusions or cuts that form a lattice array of pillars of matrix that sit upon the intact base of the foam during the manufacturing process. Although other manufacturers have introduced products that have grid patterns cut into the surfaces of their devices, no manufacture has considered the use of resulting protrusions of foam of the grid pattern for the purpose of customizing the device to the contours of the anatomy of the individual patient. Furthermore, the grid patterns in other inventions are excessively large (Raburn, et al, US 00D3945785) and too short to provide utility as a customizable device. The grid manufacturing of other inventions such as Raburn (Raburn, et al, U.S. Pat. No. 5,459,896) are accomplished by forming significantly wide channels in the matrix on the patient contact side of the matrix of the foam. These channels are intended for purposes such as ventilation of perspiration and to prevent shear injury when the patient moves. Since these structures are essentially dispersed they lack one of the benefits of intact foam, namely support. In other words, the structures do not benefit from the lateral support of adjacent structures. In some applications this might be beneficial to the patient but where the care needs prescribe support, weight distribution, offloading and positioning they are deficient. In the present invention the pillars are cut into the matrix to between 55% to 90% of the depth of the matrix into the anatomical contact side of the device. The cuts remove little or no matrix so that there are no channels formed between the pillars that stand on the intact base of the material. In addition, the lattice formation of pillars is constructed only in the appropriate area of the device that will substantially be in contact with the anatomic region of the patient. The importance of this feature is that the adjacent pillars provide lateral support to one another so that the overall affect is an action of intact unmodified foam thus providing precise positioning and offloading while maintaining overall weight redistribution.

In use the narrow pillars of matrix in the lattice array are intended to be partially or completely removed by simply pinching off the portion that needs to be removed. This selective action can be used to form a very precise depression in the foam that fits the contours of the anatomical region of the patient. These pillars are sufficiently narrow but long enough so that they can easily be grasped by the care giver, a process that would not be practical with larger protrusions of foam or with intact foam. By moving from pillar to pillar it is possible then to create a contoured depression in the support device that is an exact fit to the anatomical area that is in need of weight redistribution or total offloading. This procedure is one of choosing or picking the correct pillar for removal and then extracting or plucking out the correct amount of material that needs to be removed to create the customized support device. This "pick and pluck" procedure is repeated until a fully customized device is shaped by the care giver to fit the anatomy of the patient where it is intended to be used.

In one embodiment, a method for protecting a patient against pressure injury/ulcer formation includes a step of providing a customizable cushioning device. The device has a homogenous foam matrix with an anatomical contact side and a bottom side. The foam matrix has a depth defined by a distance between the anatomical contact side and the bottom side. The foam matrix has a lattice of cuts formed in the anatomical contact side and extending only partly through the depth of the foam matrix toward the bottom side and terminating at an intact base of the foam matrix. The lattice of cuts defines an array of adjoined pillars attached to the intact base of the foam matrix. The method further includes a step of determining an area of the foam matrix to be removed to form a conforming depression. The confirming depression is configured to accommodate contours of an anatomical region of the patient for the purpose of at least one of support, positioning, weight redistribution, and off-loading of weight of the anatomical region of the patient. The method also includes a step of manually tearing away at least a portion of the pillars at the determined area of the foam matrix to form the conforming depression in the anatomical contact side of the foam matrix. The cushioning device is thereby customized for use by the patient.

In another embodiment, a method for protecting a patient against pressure injury/ulcer formation includes a step of providing a customizable cushioning device. The device has a homogenous foam matrix with an anatomical contact side and a bottom side. The foam matrix has a lattice of cuts formed at 51% to 99% of the depth of the foam matrix in the anatomical contact side. The lattice of cuts terminates at an intact base. The lattice of cuts defines an array of adjoined pillars, which are attached to the intact base of the foam matrix. Each of the pillars have a cross-sectional area between 0.1 cm square and 100 cm square. The method further includes a step of using pressure mapping to determine an area of the foam matrix to be removed to form a conforming depression. The confirming depression is configured to accommodate contours of an anatomical region of the patient for the purpose of at least one of support, positioning, weight redistribution, and offloading of weight of the anatomical region of the patient. The method also includes a step of manually tearing away at least a portion of the pillars at the determined area of the foam matrix to form the conforming depression in the anatomical contact side of the foam matrix. The cushioning device is thereby customized for use by the patient.

BRIEF DESCRIPTION OF THE DRAWINGS

The drawings described herein are for illustrative purposes only of selected embodiments and not all possible implementations and are not intended to limit the scope of the present disclosure.

DETAILED DESCRIPTION

Figure 1:
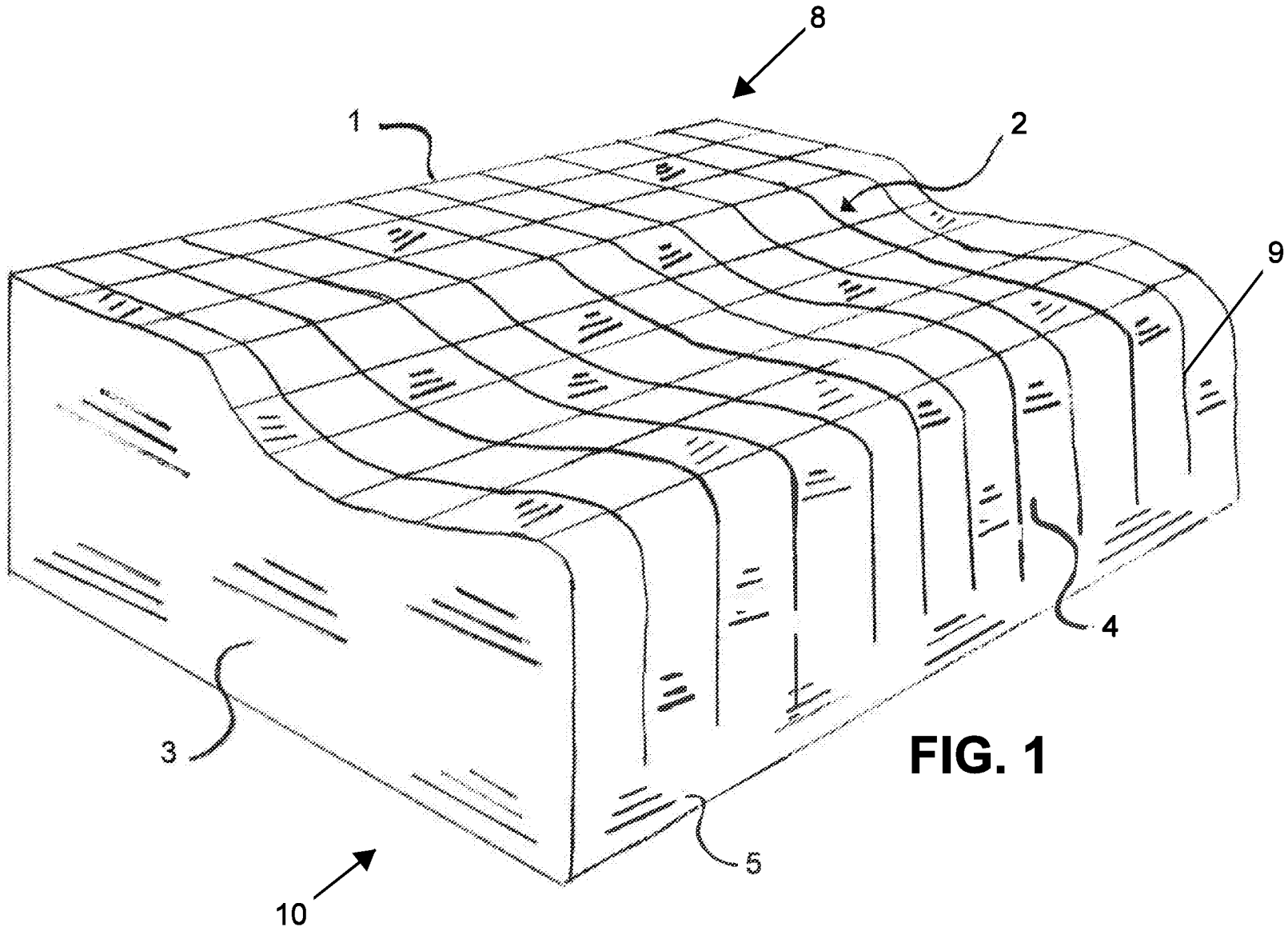
FIG. 1 is a perspective view of a device according to one embodiment of the disclosure.

The following description is merely exemplary in nature and is not intended to limit the present disclosure, application, or uses. It should be understood that throughout the drawings, corresponding reference numerals indicate like or corresponding parts and features. In respect of the methods disclosed, the order of the steps presented is exemplary in nature, and thus, is not necessary or critical unless otherwise disclosed.

FIG. 1 depicts a block of foam that has been cut into an appropriate shape for cervical support form. The upper portion of the device 1 illustrates the anatomy contact side of the device 1 with a lattice array 2 of cuts into the matrix 3 of the homogeneous foam 3 of the device 1. The independent pillars 4 of matrix 3 formed in the cutting process stand upon the intact base 5 of matrix 3 of the foam device 1. The overall shape of the device 1 in this depiction is appropriate for supporting the cervical region of the anatomy.

Figure 2:
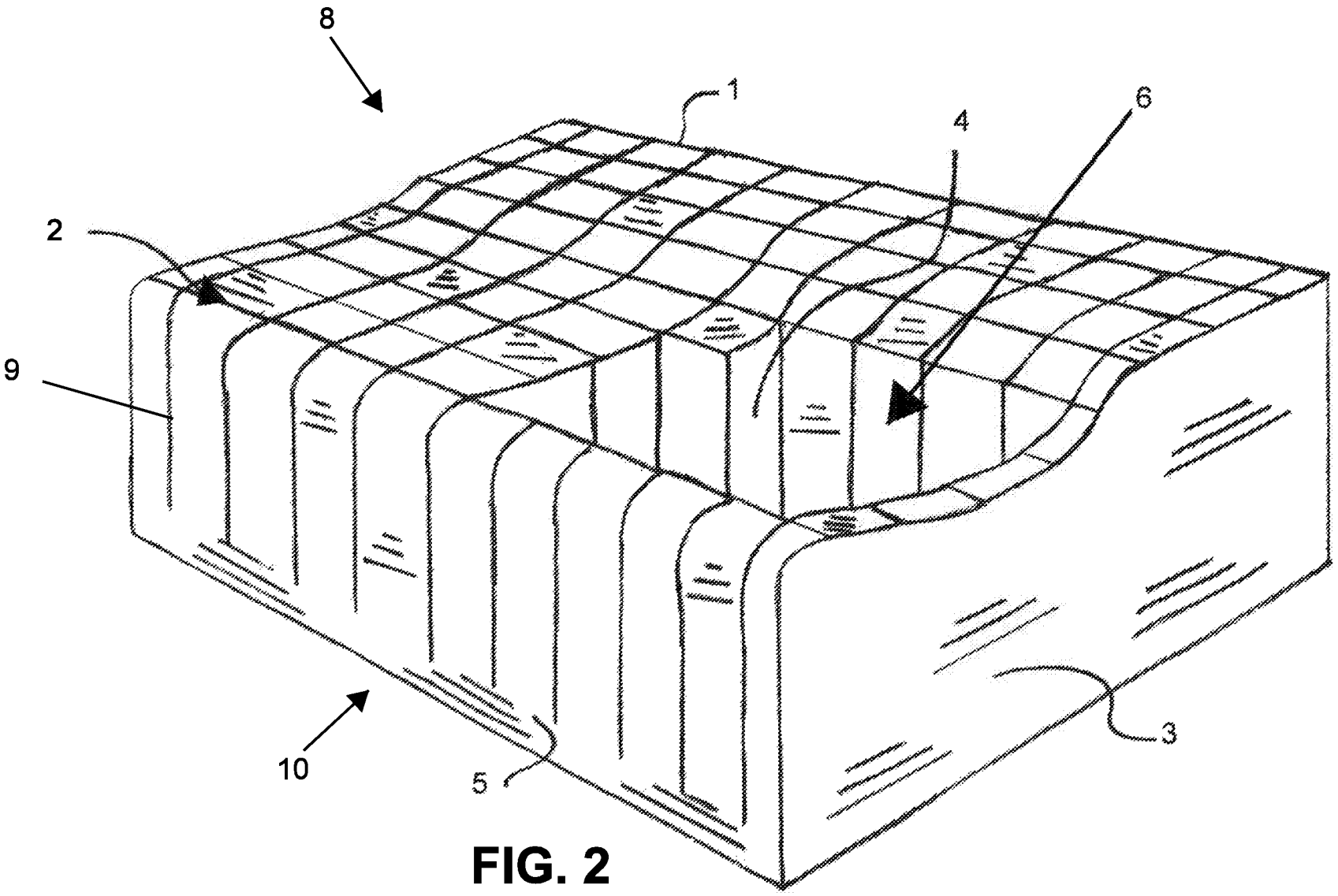
FIG. 2 is a perspective view of the device shown in FIG. 1, and further depicting a depression created by a selective removal of portions or all of selected pillars to confirm to an anatomical region of a patient.

FIG. 2 depicts a block of foam that has been cut into an appropriate shape of the device 1 for cervical support form. In particular, the device 1 further has a lattice array 2 cut into the foam from the anatomy contact side of the device 1. The device 1 has a homogeneous foam matrix 3 with an overall form for cervical support. The device 1 further has an independent pillar 4 of foam resting on the intact base 5 of the device 1. The intact base 5 of matrix 3 supports the pillars 4 of foam. A depression 6 in the construct is created by the selective removal of portions or all of selected pillars 4 to conform to an anatomical region of the patient.

Figure 3:
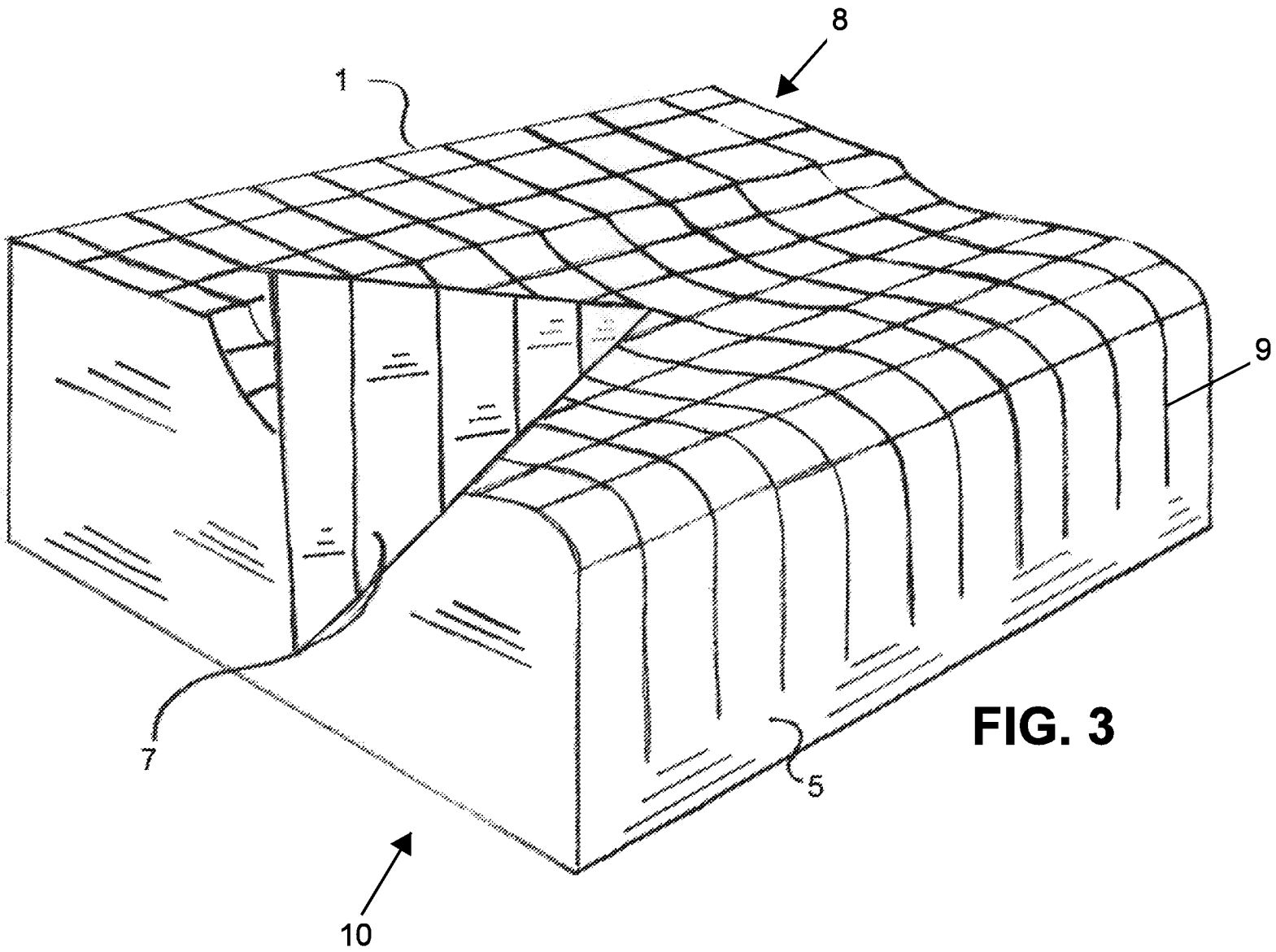
FIG. 3 is a perspective view of the device shown in FIG. 1, and further depicting a cutaway to illustrate independent pillars of foam supported on an intact base of matrix material.

FIG. 3 illustrates the anatomy contact side of the device 1, and the intact base 5 of the device 1. A cut away 7 of the foam matrix 3 is shown to illustrate the independent pillars 4 of foam supported on the intact base 5 of matrix 3 material.

Figure 4:
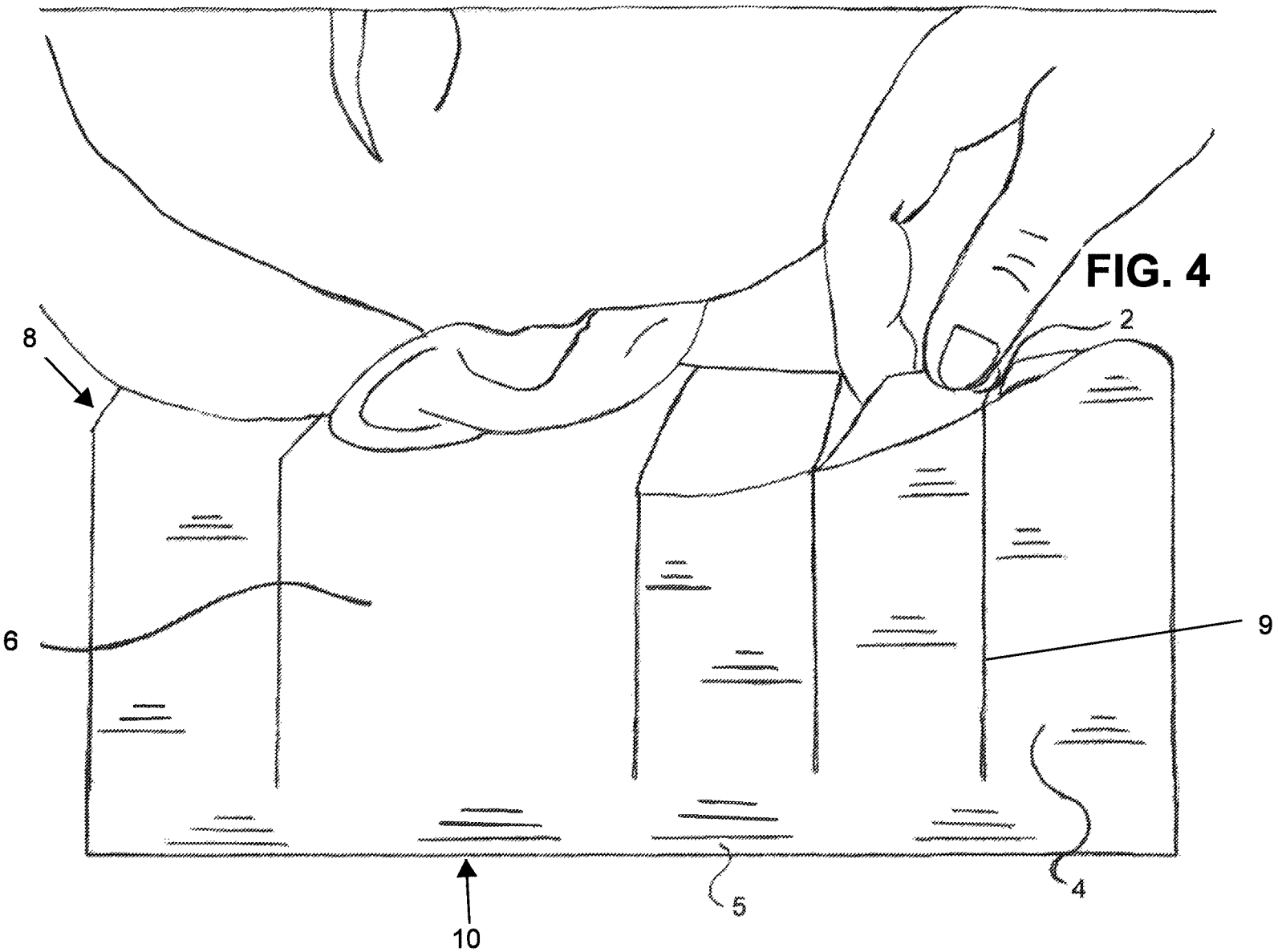
FIG. 4 is a side elevational view of the device shown in FIGS. 1-3, and further illustrating the device in operation according to the method of the present disclosure.

FIG. 4 illustrates the preparation of the device 1 for use wherein the device 1 is an independent unmodified pillar 4 of matrix 3 sitting upon the intact base 5 of the device 1. The pillars 4 of foam may be manually shortened as to form a depression 6 in the matrix 3 appropriate for offloading and redistributing the weight of the patient's anatomy.

Figure 5:
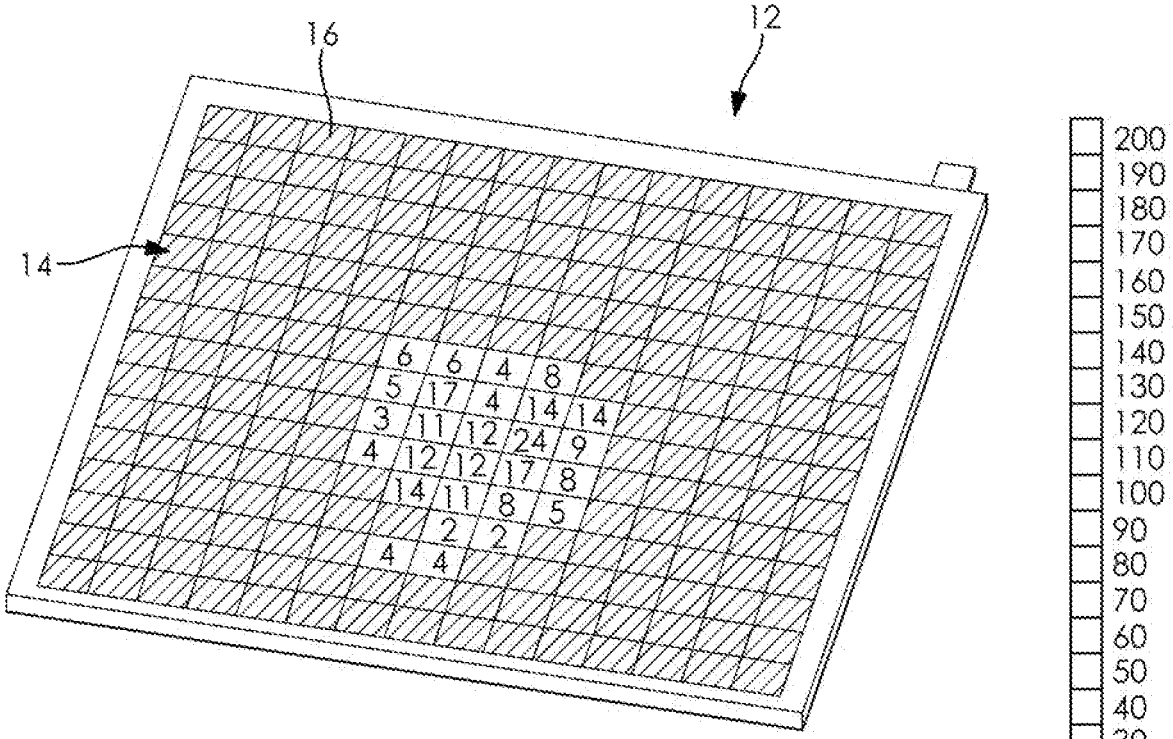
FIG. 5 is a front perspective view of a pressure mapping display of a body of a patient that corresponds to the device shown in FIGS. 1-4.

FIG. 5 depicts a pressure map of a body of a patient, illustrating the areas of pressure where the body contacts a pressure mat.

Figure 6:
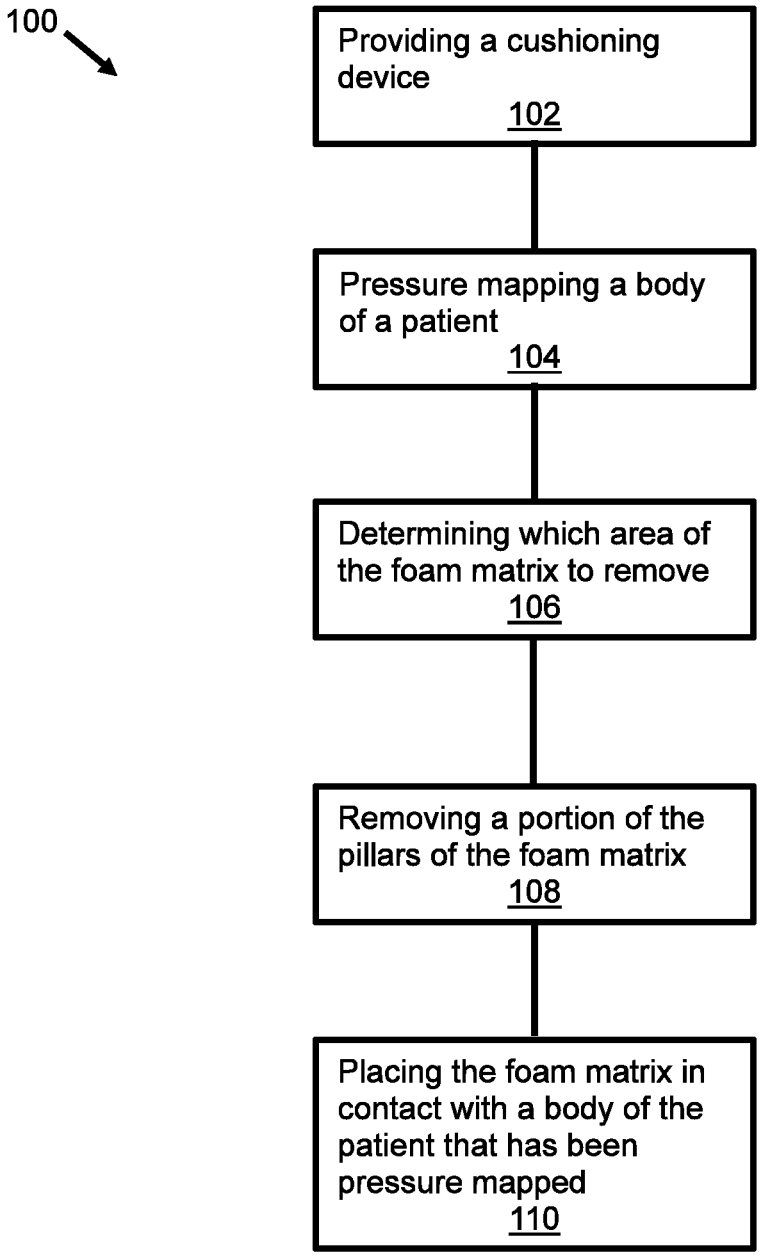
FIG. 6 depicts a method of protecting against pressure injury/ulcer formation by modifying the device shown in FIGS. 1-4.

FIG. 6 illustrates a method of pressure mapping a patient to determine which area of the foam matrix to remove.

All of the devices 1 of the invention are comprised of a cushioning support matrix 3 such as a polyurethane foam or other such elastomeric foams. In all cases the foam may be generally cut to a size and overall shape suitable for its intended application. For example, a wheel chair cushion would be cut to a shape and form that is sufficient to fit in a wheel chair with sufficient thickness so that it would not be compressed so far that it bottoms out when used by a patient.

Elastomeric foam and in particular polyurethane foam is formed from stock buns that are then used as the raw material for the manufacturing of cushioning devices 1 of this subject invention. These stock foam buns are then cut in any suitable manner to form the general dimensions of the finished device 1. Cutting is accomplished by the use of a foam cutting knife or wire fitted in a programmable foam cutting machine. This cutting of the raw shape could be accomplished by other methods that might commonly be employed for the cutting of such materials. If the intended use of the device 1 were to be a wheel chair seat, then the foam would be cut to an appropriate size to fit a wheel chair support. Usually such devices 1 are then packages as is or have additional material added to them such as coatings or covers to make the finished device 1. In the case of the subject invention additional cuts made substantially through the foam matrix 3 would be applied to the surface that is intended to make contact with the anatomy. These cuts would form a closely packed lattice array 2 of pillars 4 in the foam that stand on the intact base 5 of the foam matrix 3.

The tightly packed lattice array 2 of pillars 4 of the foam matrix 3 are substantially made in the foam matrix 3 on a patient contact side 8 of the device 1. The grid-like distribution of pillars 4 enables the patient or care giver the opportunity to decide where the customizing of the device 1 is to occur. By picking and plucking away the pillars 4 of the foam matrix 3, it is easy to form the depression 6 in the material that conforms to the anatomy of the patient surface that is targeted for support and offloading. The remaining intact portions of the pillars work in consort with neighboring pillars 4 to act in a fashion similar to that expected of a solid matrix 3 of material. In other word's there is no appreciable space between the pillars 4 of the foam matrix 3. This is particularly important for position of a region of the anatomy. The contiguous nature of the customized shape provides the necessary support, positioning and weight redistribution to aid in the avoidance of the formation of pressure injuries in the patient.

A variation of the theme is the formation of cushioning devices 1 that are generally contoured by the foam cutting process to conform to the general anatomical shape that is intended for support. For instance, a device 1 cut from polyurethane foam to form a flat bottom and sides but has a contoured top surface that conforms to the contours of the anatomy. One such device 1 is formed so that it conforms to the back of the head and the cervical area. Once this shape is achieved then the entire top area of the device 1 is cut partially the way to the bottom of the foam matrix 3 to form the lattice array 2 of foam pillars 4. Such a device 1 is then more precisely modified to fit the patient by the selective removal of portions of the pillars 4 of foam to form a depression 6 that would specifically conform to the head and neck area. If some part of that anatomy requires total offloading, then a significantly large part of the pillars 4 in that specific region could be removed so that the device 1 makes no contact with the anatomy in that specific anatomical region.

In certain embodiments, the customizable cushioning device 1 includes a homogenous foam matrix 3 with the anatomical contact side 8 and a bottom side 10. The foam matrix 3 of the customizable cushioning device 1 may have a depth defined by a distance between the anatomical contact side 8 and the bottom side 10. The foam matrix 3 may have a lattice of cuts 9 formed in the anatomical contact side 8 and extending only partly through the depth of the foam matrix 3 toward the bottom side 10. The lattice of cuts 9 may terminate at an intact base 5 and define an array 2 of adjoined pillars 4 attached to the intact base 5 of the foam matrix 3.

In a further embodiment, as shown in FIG. 5, a body of a patient may be pressure mapped to reveal areas of high pressure and to allow one to determine an area of the foam matrix 3 to be removed. Once the body of the patient is pressure mapped, pieces of the foam matrix 3 may be manually removed to lower the amount of pressure exerted by the cushioning device 1 on the patient in operation, thereby militating against injury and the formation of ulcers. For example, in certain embodiments, the pressure mapping may be performed using a sensing mat (shown on the display 12 in FIG. 5) having a plurality of pressure sensors. In a further example, the body of the patient may abut the sensing mat to reveal areas of high pressure that could potentially cause injury. Data is communicated from the pressure sensors to a user interface, such as a monitor or touch screen, which in turn shows a pressure mapping display 12.

The pressure mapping display 12 may graphically depict a pressure mapping grid 14 that has a plurality of boxes 16, which each may be assigned a pressure reading in mmHg. In a non-limiting example, the boxes 16 of the grid may correspond to individual pieces of the foam matrix 3. Thus, the pressure reading shown in each box 16, may correspond to an individual pillar 4 of the foam matrix 3. One of ordinary skill in the art may also select other types of the display 12 for graphically depicting the pressure mapping of the body of the patient, as desired.

In a further example, data collected by the sensors may be accessed by the user via at least one personal computer or mobile appliance, such as a mobile phone or a tablet computer. In particular, the sensors may send the data to a web browser on the personal computer, or through a downloadable software application on the mobile phone or the personal computer. After reviewing the pressure readings in each box 16 of the mapping display 12, the user may then selectively remove portions of the pillars 4 of foam to form a depression 6 that would correspond to areas of high pressure. The greater the amount of pressure, the larger portions of foam pillars 4 that may be removed. The software application may further be configured to suggest to the user the amount of each pillar 4 to be removed in order to optimize the relief of pressure to the body of the patient in operation.

In non-limiting examples, the patient may be anyone at risk for pressure injuries or already having the pressure injuries, anyone on life support, any bed bound patients that are compromised, any persons that are confined to long hours of sitting, a handicapped person with contractures, those with disabilities, burn victims, surgical patients, or patients undergoing dialysis. The system and method may also be used with other suitable patients, as desired.

In particular embodiments, as shown in FIG. 6, a method 100 for protecting a patient against pressure injury or ulcer formation may include a first step 102 of providing the customizable cushioning device 1. In a second step 104, the user may pressure map the body of the patient to reveal areas of high pressure. In a third step 106, the user determines the areas of the foam matrix 3 to be removed, in order to form the conforming depression 6 configured to accommodate contours of an anatomical region of the patient. It should be appreciated that the conforming depression 6 advantageously facilitates redistribution and offloading of weight of the anatomical region of the patient, as set forth hereinabove. In a fourth step 108, the identified pieces of the foam matrix 3 may be removed, in order to form the conforming depression 6 configured to accommodate contours of the anatomical region of the patient. For example, the user may manually tear away at least a portion of the pillars 4 at the determined area of the foam matrix 3 to form the conforming depression 6 in the anatomical contact side 8 of the foam matrix 3. In a fifth step 110, the foam matrix of the cushioning device may be disposed adjacent and contact the body of the patient that was pressure mapped, in order to provide cushioning and support while also minimizing an opportunity for formation of pressure ulcers.

The utility of the invention was proven by making and testing several prototypes. Some examples of these prototypes include:

Example 1

A device 1 that incorporates the features of the disclosure was developed by cutting a block of polyurethane foam into a block 9"×7"×1.5" using a continuous programmable foam block cutter. The cut foam block from this process was then subjected to a secondary cutting operation that cut parallel cuts 0.5" wide and 1.25" deep across one surface of the foam. This process was repeated in a perpendicular direction to the first set of parallel cuts. The resulting appearance of one side of the foam was a cross hatching of pillars 4 of foam 0.5"×0.5" that extended into the foam 1.25". Since the pillars 4 were not cut entirely through to the opposite side of the foam the entire device 1 remained intact. The other side of the foam was uniform without any evidence of cross hatching.

The utility of the device 1 was demonstrated by customizing it to fit a 4" diameter soft ball. The soft ball was placed in the center of the device 1 and a felt pen was used to outline the edge of the area to be customized. The pillars 4 within the marked area were then picked and plucked with the ones in the center being pinched off and removed at their bases 5 and the ones out towards the perimeter being sequentially pinched off closer to the outer top surface. Once the customizing was complete, a depression 6 in the foam was created so that the soft ball would nestle into the depression 6 with substantially uniform contact with pillars 4 of foam. This customizing required only a few minutes to carry out and did not require any special equipment or machinery to complete.

Example 2

Essentially the same device 1 was made as in example 1, except that the density of foam in this example was significantly lower than the first example. This created a softer support device 1 that conformed to the desired shape, and bottoming out did not occur when it was tested.

Example 3

This device 1 was cut in the same form as that in the first example device 1 except that the size was approximately 12"×9"×3", which was found to be more conducive for use on an adult patient.

Example 4

Polyurethane foam was initially cut to form a shape with a contoured shape that would generally fit the contour of the neck and head region of a patient. The contoured block was generally 9"×7"×1.5" in size. The anatomical contact side 8 of the device 1 had a series of cuts 9 in a grid like fashion that extended from the surface into the matrix 3 to 0.5" from the bottom (66% of the depth). The device 1 was placed in use to support and offload a baby's head by selectively removing portions of pillars 4 in the central region of the foam to form a depression 6 that precisely fit the head of the baby.

Example 5

Often, where positioning a patient in the proper position, the patient may be positioned with the non-operative side on the surgical surface. Proper alignment, adequate stabilization and support of extremities with sufficient padding minimize integumentary, circulatory and musculoskeletal injury. However, even the most ideal techniques may result in tissue damage, where poorly designed positioning equipment is purchased and used. Additionally, it should be appreciated that the cushioning device 1 may be adapted to the accommodate the occipital bones, or earlobes of the patient. Furthermore, the cushioning device 1 may also be customized for different types of lines, necessary for medical equipment. For example, these lines may be run from the patient's neck or clavicle area to the machine. Depending on how many lines required for the surgical procedure, the cushioning device 1 may be customized to accommodate the lines as well the occipital bones and ear lobes of the patient.

Example 6

Where the patient is brought to a hospital as a trauma patient with head injuries and internal bleeding, one may customize the cushioning device 1 to accommodate the head to alleviate any further swelling to the brain.

Example 7

Patients recovering after lengthily surgery may experience fluid build-up in the back of the head, which increases pressure on the occipitals. Other cushioning devices, including gel cushioning devices, tend to bottom out or cause increased pressure, and do not provide true off-loading of pressure. However, the present cushioning device 1 is customized to support the patients' occipital bones and earlobes for pressure relief. The customizable cushioning device 1 subject to a pressure reading machine, provides pressure readings below 32 mmhg, which is well below the AHRQ government guidelines.

While certain representative embodiments and details have been shown for purposes of illustrating the invention, it will be apparent to those skilled in the art that various changes may be made without departing from the scope of the disclosure, which is further described in the following appended claims.

What is claimed is:

1. A method for protecting a patient against pressure injury/ulcer formation, the method comprising steps of:

providing a customizable cushioning device including a homogenous foam matrix with an anatomical contact side and a bottom side, the foam matrix having a depth defined by a distance between the anatomical contact side and the bottom side, the foam matrix having a lattice of cuts formed in the anatomical contact side and extending only partly through the depth of the foam matrix toward the bottom side and terminating at an intact base, the lattice of cuts defining an array of adjoined pillars attached to the intact base of the foam matrix, wherein an entirety of the lattice of cuts forms continuous cuts about each pillar at a surface of the anatomical contact side;

determining an area of the foam matrix to be removed by pressure mapping the patient with sensors to form a conforming depression configured to accommodate contours of an anatomical region of the patient for purpose of at least one of support, positioning, weight redistribution, and offloading of weight of the anatomical region of the patient; and manually tearing away at least a portion of the pillars at the determined area of the foam matrix to form the conforming depression in the anatomical contact side of the foam matrix.

2. The method of claim 1, wherein the foam matrix is one of polyurethane foam, viscoelastic foam, polyvinyl foam, natural rubber, and synthetic rubber.

3. The method of claim 1, wherein the cut depth is from 51% to 99% of the depth of the foam matrix.

4. The method of claim 3, wherein the cut depth is from 60% to 95% of the depth of the foam matrix.

5. The method of claim 1, wherein each of the pillars has a cross-sectional area from 0.1 cm square to 100 cm square.

6. The method of claim 5, wherein each of the pillars has a cross-sectional area from 0.5 cm square to 16 cm square.

7. The method of claim 6, wherein each of the pillars has a cross-sectional area from 1 cm square to 2 cm square.

8. The method of claim 1, wherein each of the pillars contacts adjacent ones of the pillars and there are no channels formed therebetween, the adjacent ones of the pillars thereby providing lateral support.

9. The method of claim 1, wherein the step of manually tearing away the pillars includes pinching off by a user the portion of the pillars at the determined area to form the conforming depression.

10. The method of claim 9, wherein one of the pillars at the determined area is pinched off at the intact base, and another of the pillars at the determined area is pinched off at a location between the intact base and the anatomical contact side.

11. The method of claim 1, wherein the anatomical contact side is contoured during formation of the foam matrix and prior to the step of manually tearing way the pillars to form the conforming depression, the anatomical contact side configured to generally conform to the contours of the anatomical region of the patient.

12. The method of claim 1, wherein the anatomical region includes a head and a neck of the patient.

13. The method of claim 12, wherein the conforming depression is configured to receive an ear of the patient where the head is placed on the anatomical contact side of the customizable cushioning device.

14. The method of claim 1, wherein the foam matrix is generally block shaped.

15. The method of claim 1, wherein the foam matrix is approximately 9-12 inches in length by 7-9 inches in width by 1.5-3 inches in depth.

16. A cushioning device for protecting a patient against pressure injury/ulcer formation, the cushioning device having been customized according to the method of claim 1.

17. The method of claim 1, wherein the lattice of cuts defining the array of adjoined pillars attached to the intact base of the foam matrix form continuous cuts about a circumference of each pillar from the surface of the anatomical contact side to the intact base.

18. The method of claim 1, wherein a portion of the anatomical contact side has a curved surface.

19. The method of claim 1, wherein the step of manually tearing away the pillars includes pinching off by a user the portion of the pillars at the determined area to form the conforming depression by tearing away the pillars at only a base of each pillar, leaving an intact base.

* * * * *